US005429231A

United States Patent [19]

McSpadden

[11] Patent Number: 5,429,231

[45] Date of Patent: * Jul. 4, 1995

[54] PORTABLE FOOD TRAY WITH CUP HOLDER

[75] Inventor: Douglas S. McSpadden, Belmont, N.C.

[73] Assignee: Plateware International, Belmont, N.C.

[ * ] Notice: The portion of the term of this patent subsequent to Sep. 13, 2011 has been disclaimed.

[21] Appl. No.: 257,385

[22] Filed: Jun. 9, 1994

Related U.S. Application Data

[63] Continuation-in-part of Ser. No. 87,655, Jul. 6, 1993, Pat. No. 5,346,070.

[51] Int. Cl.[6] ..... B65D 1/36

[52] U.S. Cl. ..... 206/217; 206/549; 220/556

[58] Field of Search ..... 206/541, 545, 557, 558, 206/560, 561, 564, 217, 549; 220/23.8, 23.83, 23.86, 555, 556, 574, 575, 737

[56] References Cited

U.S. PATENT DOCUMENTS

| | | |
|---|---|---|
| D. 55,495 | 6/1920 | White . |
| D. 130,502 | 11/1941 | King . |
| D. 152,659 | 2/1949 | Sloan . |
| D. 157,700 | 3/1950 | Price . |
| D. 159,454 | 7/1950 | Waltman . |
| D. 166,735 | 5/1952 | Chaplin . |
| D. 168,327 | 12/1952 | Alper . |
| D. 169,133 | 3/1953 | Foster . |
| D. 185,872 | 8/1959 | Forsman . |
| D. 185,911 | 8/1959 | Chadbourne . |
| D. 192,374 | 3/1962 | Wittke . |
| D. 278,197 | 4/1985 | Harper . |
| D. 278,198 | 4/1985 | Harper . |
| D. 284,157 | 6/1986 | Morr . |
| D. 288,513 | 3/1987 | Shelly . |
| D. 290,919 | 7/1987 | Beute . |
| D. 311,662 | 10/1990 | Lorenzana et al. . |
| 1,595,356 | 8/1926 | Moseman . |
| 3,955,672 | 5/1976 | Brundage . |
| 4,206,842 | 6/1980 | Burridge, Jr. . |
| 4,991,713 | 2/1991 | Phillips . |

FOREIGN PATENT DOCUMENTS

| | | |
|---|---|---|
| 2243360 | 10/1991 | United Kingdom . |
| 9220586 | 11/1992 | WIPO . |

*Primary Examiner*—Jimmy G. Foster

*Attorney, Agent, or Firm*—Bell, Seltzer, Park & Gibson

[57] ABSTRACT

A portable food tray for supporting food and a drink container which is adapted to be securely and comfortably held by one hand of the user. The food tray is formed from a sheet material and has a generally flat surface portion and a cup-like portion for supporting a drink container. An interconnecting wall portion connects the cup-like portion to the flat surface portion so that sufficient space is provided to permit the thumb and at least the index finger of the user to surround and grip the outside of the cup-like portion. Also, the top of the cup-like portion is spaced a substantial distance above the flat surface portion so as to permit the "nesting" of the tray down onto the hand and to thereby permit the tray to be stabilized on the hand.

9 Claims, 3 Drawing Sheets

PORTABLE FOOD TRAY WITH CUP HOLDER

CROSS REFERENCE TO RELATED APPLICATION

This application is a continuation-in-part of application Ser. No. 08/087,655, filed Jul. 6, 1993.

BACKGROUND OF THE INVENTION

At social functions where food is served, such as cocktail parties and wedding receptions, the host will often elect to provide disposable plates for their guests to use. Disposable plates are typically made of plastic or paper and are relatively inexpensive as compared to non-disposable plates, such as those made of china or glass. The use of disposable plates also makes cleaning up after a social function considerably easier and quicker by eliminating the need to wash the plates after use.

In addition to food, drinks are often served at these functions. The drinks are served either in plastic or paper disposable cups, or in glass bottles or aluminum cans, which can disposed of or recycled.

At many of these functions the guests are often required to stand while holding their plate and drink container. For example, the guests will be standing and holding both their plate and drink container while passing through a buffet line and when returning to their seats. In addition, some guests may choose to stand because of a desire to mingle and perhaps all of the guests will have to stand because of a lack of seats.

Conventional disposable plates are usually of a simple geometric shape, such as a circle, and may be divided into two or more separate food compartments. In order to hold such a plate and a drink container while standing, the guest must use both hands, one to hold the plate and the other to hold the drink. This is very inconvenient when the guest needs at least one hand free, such as when eating or shaking hands, and may require that the guest find a nearby surface, such as a table or even the floor, upon which to place the drink container. In addition to the inconvenience of having to put the drink container down, the guest's drink may be knocked over or even confused with the drink containers of other guests if many guests are present at the function.

Some food trays of the prior art incorporate a flat surface portion and a cup-like portion formed in the upper surface of the plate for supporting both food and a drink container. For example, Design U.S. Pat. No. 311,662 to Lorenzana et al. and Design U.S. Pat. No. 152,659 to Sloan disclose food trays of this type. Although the plates of this type are capable of supporting a drink container, they are either not designed to be portable or require that the user hold the tray with both hands.

If trying to hold a conventional food tray with one hand, most users would support the tray by grasping the rim of the tray. When a full cup or can is placed in the drink container holder of one of these trays, however, the tray becomes very unbalanced because of the added weight and makes it difficult, if not impossible, to hold the tray with one hand. Therefore, most users must compensate by grasping the rim of the plate with both hands. This is especially true when the plate is also fully laden with food. In addition, if the tray is made of a relatively non-rigid material, such as paperboard or thin plastic, as is common with most disposable trays of this type, there is a high risk of structural failure when the fully laden tray is grasped at only one point on its rim.

Alternatively, users may support a food tray or plate by placing the plate on an open hand with the palm facing upwards. This carrying position, however, is uncomfortable and makes a fully laden plate feel top-heavy. This is especially true with food trays that are also supporting a full cup or can.

Other disposable plates with cup holders present in the prior art include thumbholes that help the user support the plate with one hand. See, for example, Design U.S. Pat. No. 290,919 to Buete, and Design U.S. Pat. Nos. 278,198 and 278,197 to Harper. The thumb helps to balance the plate and the rest of the hand supports the weight of the plate. The main disadvantage of this arrangement, however, is that the thumb is exposed above the surface of the plate and is proximate to the food compartments. Thus, it is relatively easy to spill food on the exposed thumb of the user.

Therefore, it is an object of the present invention to provide a portable food tray that overcomes the deficiencies present in the prior art.

It is another object of the invention to provide a portable food tray capable of supporting a drink container.

It is still another object of the invention to provide a portable food tray that can be easily and comfortably supported with one hand.

It is still another object of the invention to provide a portable food tray that can be easily and comfortably supported with one hand and which does not expose the thumb of the user to food.

SUMMARY OF THE INVENTION

These and other objects and advantages of the present invention are achieved in the embodiments illustrated herein by the provision of a portable food tray for supporting food and a drink container and which is adapted to be securely and comfortably held by one hand of the user. The portable food tray is formed from a self supporting sheet material which is shaped to include a generally flat surface portion and a cup-like portion which is sized to receive a drink container. The cup-like portion includes a substantially cylindrical wall, an upper open end, and a bottom end which may be closed with a bottom wall. The cylindrical wall defines a central axis and has an axial dimension of at least about 1½ inches.

The portable food tray has an interconnecting wall portion, including an annular wall segment and a depending wall segment, which interconnects the upper end of the cup-like portion to the flat surface portion so that the central axis of the cylindrical wall extends perpendicularly to the flat surface portion. The depending wall segment of the interconnecting wall portion is spaced from the cylindrical wall at a distance of at least about ¾ inches around the periphery of the cylindrical wall to permit the thumb and at least the index and preferably second fingers of the user to surround and grip the outside of the cylindrical wall of the cup-like portion.

The portable food tray further includes a peripheral outer edge portion, which extends upwardly from the periphery of the flat surface portion, and preferably has the configuration of an inverted U about at least the majority of its length. The peripheral outer edge portion also defines an upper surface which is spaced above the flat surface portion.

In accordance with the present invention, the annular wall segment of the interconnecting wall portion is spaced above the flat surface portion a distance equal to at least about twice the spacing between the upper surface of the peripheral outer edge portion and the flat surface portion.

In one embodiment of the invention, the peripheral outer edge when viewed in plan, includes a generally convex side edge portion and an opposite generally concave side edge portion. Also, the cup-like portion is positioned adjacent the convex side edge portion and two ribs, also having the configuration of an inverted U, extend from the depending wall segment of the cup-like portion to the concave side edge portion so as to divide the flat surface portion into three compartments. The two ribs are each sized so as to accommodate a portion of the hand or wrist of the user therein when gripping the cup-like portion and to thereby further support and stabilize the tray.

In another embodiment of the invention, the peripheral outer edge portion of the food tray is circular in shape when viewed in plan, and the tray has no ribs.

The cylindrical wall of the cup-like portion preferably has a slightly conical configuration and the other generally vertical features of the tray are slightly laid back so as to define a small included angle with the central axis and so as to permit nesting of the tray with another like tray.

BRIEF DESCRIPTION OF THE DRAWINGS

Some of the objects and advantages of the present invention having been stated, others will appear as the description proceeds when taken in conjunction with the accompanying drawings, in which.

DETAILED DESCRIPTION OF THE PREFERRED EMBODIMENTS

Figure 1:
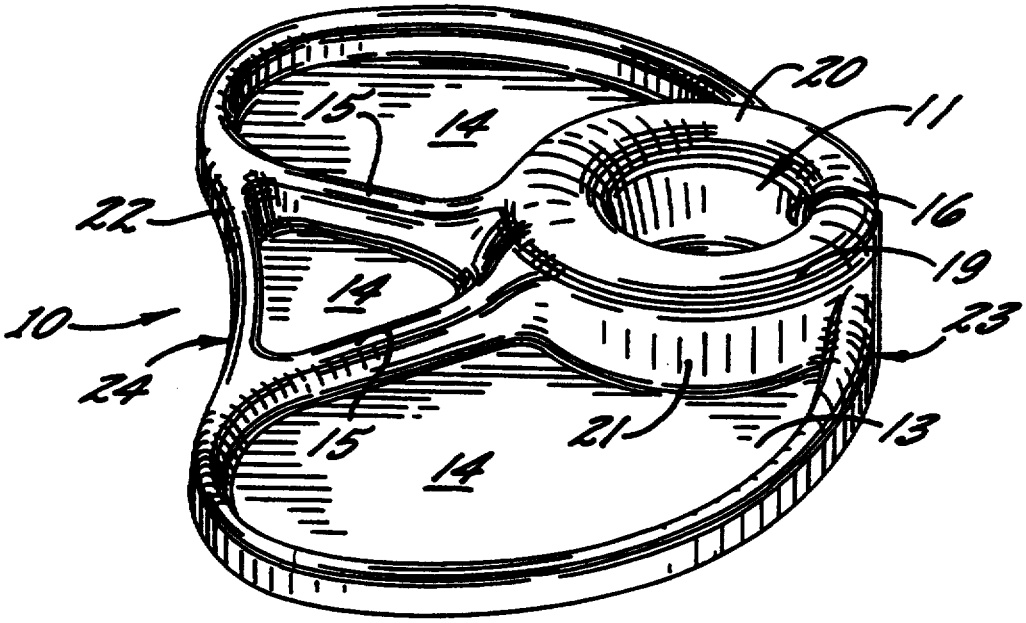
FIG. 1 is a perspective view of the top side of the portable food tray of the present invention.
Figure 2:
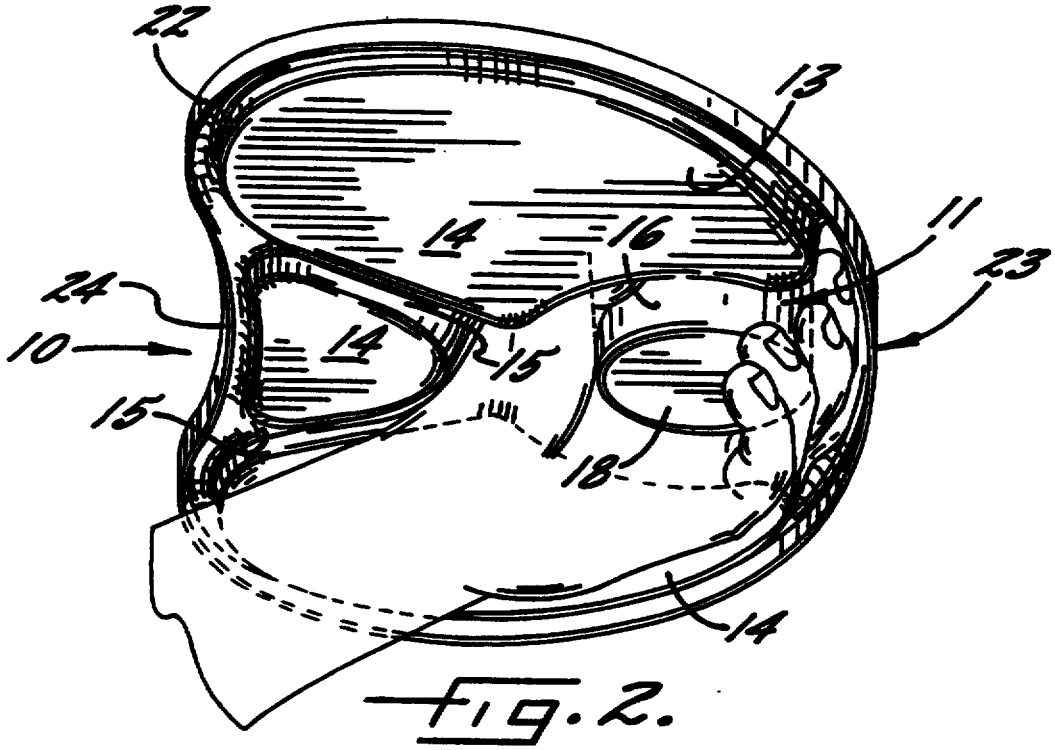
FIG. 2 is a perspective view of the bottom side of the portable food tray of the present invention, illustrating the hand of the user.
Figure 4:
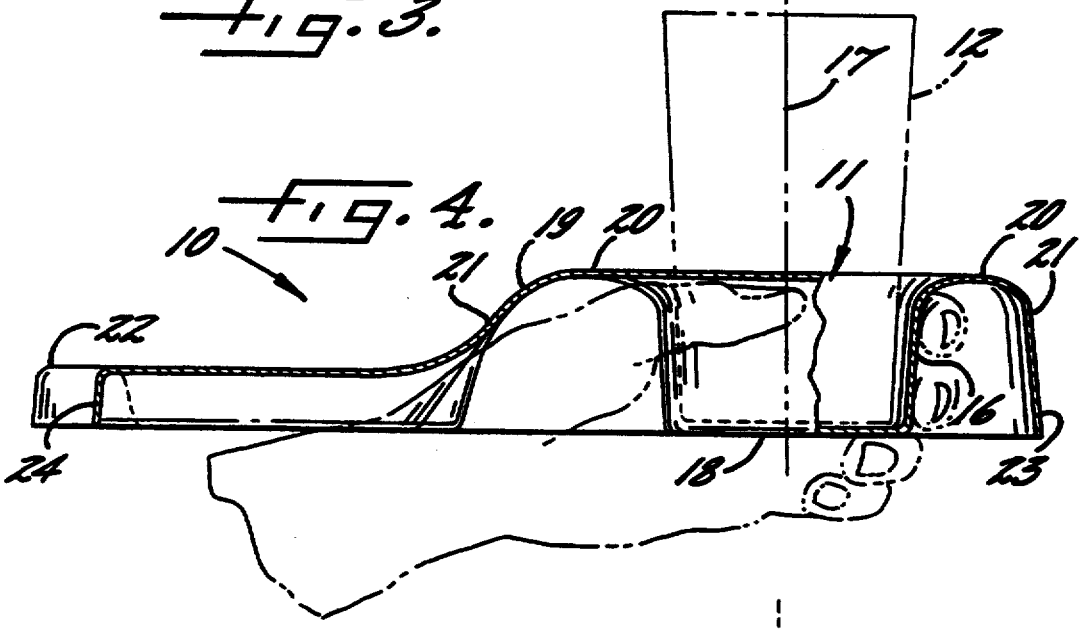
FIG. 4 is a sectional view of the portable food tray of the present invention taken along line 4—4 and illustrating in phantom the user's hand and a drink container.

Referring more particularly to the drawings, FIG. 1 illustrates the portable food tray 10 of the present invention. The food tray can support food and a drink container 12 and is adapted to be portable so that the user can hold and support the food tray with one hand. As shown in FIGS. 2 and 4, the user supports the food tray 10 by grasping the underside of a cup-like portion 11 that accommodates the drink container 12. The food (not shown) is supported on a generally flat surface portion 13 in compartments 14 separated by ribs 15 formed in the flat surface portion 13.

The underside of the tray is configured with sufficient space to allow the user to reach up underneath the tray and place the thumb and at least the index finger, and also preferably the second finger, of one hand around the cup-like portion 11 so that the user can securely hold the cup-like portion 11, in a similar fashion to that used to hold a drink container such as a can or bottle. In addition, the underside of each rib 15 is sized so as to accommodate the upper portion of the thumb or lower portion of the wrist of the user, as best shown in FIG. 4, to further support and stabilize the weight of the food tray 10.

The portable food tray 10 is formed from any self supporting sheet material, such as glass, aluminum, plastic or paperboard, and, based on the material chosen, can be either reusable or disposable. If the food tray 10 is made of paperboard, it must also be sufficiently resistant to the absorption of liquids to prevent food items from soaking through the food tray while in use.

The sheet material is shaped to include the generally flat surface portion 13 and the cup-like portion 11 which is designed to receive drink containers of various types, such as cups, bottles or cans. The cup-like portion 11 includes a substantially cylindrical wall 16 that defines a central axis 17, an open upper end and a bottom end which is closed with a bottom wall 18. The bottom wall 18 of the cup-like portion 11 is preferably coplanar with the flat surface portion 13 so that the tray will lie flat and the bottom wall 18 of the cup-like portion 11 will be supported when the tray 10 is placed on a horizontal surface.

Figure 5:
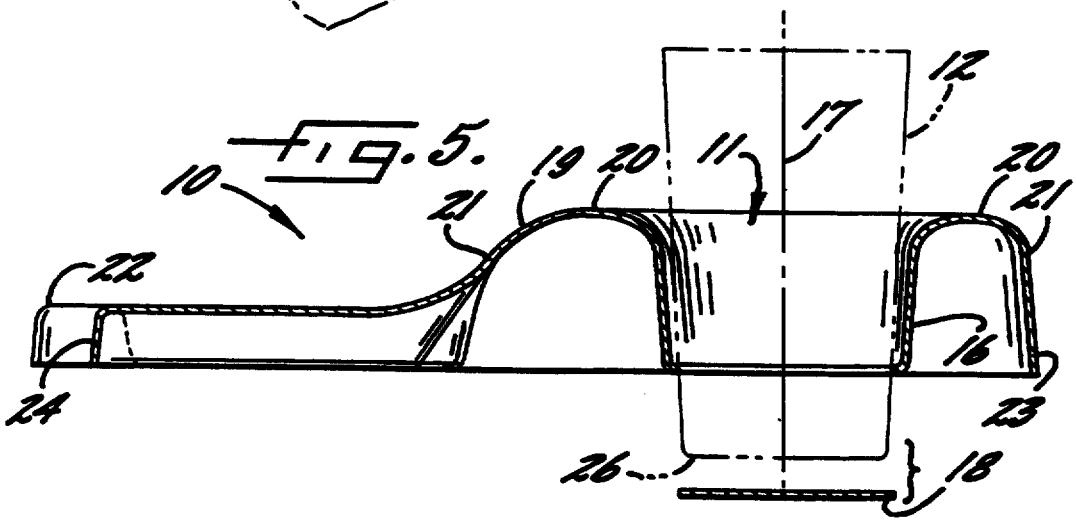
FIG. 5 is an exploded sectional view of the portable food tray of the present invention taken along line 4—4 and illustrating the perforated bottom wall removed from the cup-like portion.

The cylindrical wall 16 has an axial dimension of at least about 1½ inches to prevent the drink container 12 from tipping over and to allow the tray 10 to securely support drink containers of various heights. In addition, the bottom wall 18 of the cup-like portion 11 may be perforated so that it can be easily removed to allow the cup-like portion 11 to more readily accommodate taller cups, as schematically shown in FIG. 5. The cylindrical wall 16 also has a slightly conical configuration and defines a small included angle relative to the central axis 17 so as to permit nesting of the tray 11 with another like tray (not shown). The included angle is generally not greater than about 10 degrees and is preferably about 5 degrees.

The upper end of the cup-like portion 11 and the flat surface portion 13 of the food tray are interconnected by an interconnecting wall portion 19 so that the central axis 17 of the cylindrical wall extends perpendicularly to the flat surface portion 13. The interconnecting wall portion 19 includes an annular wall segment 20 extending from the upper end of the cup-like portion 11 and a depending wall segment 21 extending from the flat surface portion 13 and connected to the annular wall segment 20.

When viewed in cross section, such as in FIGS. 4 and 5, the depending wall segment 21 of the interconnecting wall portion 19 is generally parallel to the cylindrical wall 16 and is laterally spaced therefrom at a distance of at least about ¾ inches around the periphery of the cylindrical wall 16 so as to permit the thumb and preferably the first two fingers of the user to surround and grip the outside of the cylindrical wall 16. Preferably, the distance between the depending wall segment 21 and the cylindrical wall 16 varies around the periphery of the cylindrical wall 16. For example, the space between the depending wall segment 21 and the cylindrical wall 16 may vary from about ¾ inches, at the point on the periphery of the cylindrical wall 16 furthest away from the user, to about 1½ inches, at the point on the cylindrical wall 16 closest to the user. This spacing allows the user's hand to fit easily around the cup-like portion 11 by allowing more room for the user's thumb than non-thumb fingers and, in conjunction with the axial dimension of the cylindrical wall 16, causes the user to hold the tray 10 at a point that will usually be above the tray's center of gravity. This creates a more balanced feel to the holder of the tray.

The portable food tray 10 further includes a peripheral outer edge portion 22 that has the configuration of an inverted U about at least the majority of its length and which acts in cooperation with the ribs 15 to contain the food within the compartments 14 and to further strengthen the tray. The generally vertical surfaces of the outer edge portion 22 are slightly laid back from vertical to define an included angle not greater than about 10 degrees to permit nesting of a plurality of stacked trays.

The peripheral outer edge portion 22 extends upwardly from the periphery of the flat surface portion 13 of the tray, and defines an upper surface which is spaced above the flat surface portion 13 a distance of at least about ½ inch and preferably about ¾ inch. Also, from the above description, it will be seen that the annular wall segment 20 of the interconnecting wall portion 19 is spaced above the flat surface portion 13 a distance equal to about twice the spacing between the upper surface of the peripheral outer edge portion 22 and the flat surface portion 13. This configuration permits the "nesting" of the tray down onto the hand of the user, which in turn provides better support of the tray on the wrist and therefore better stability.

Figure 3:
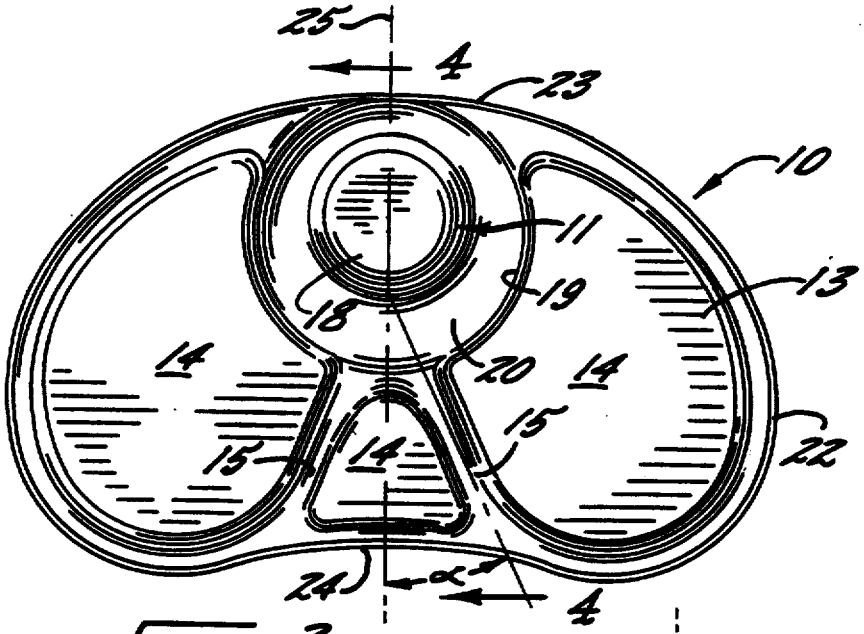
FIG. 3 is a top plan view of the portable food tray of the present invention.

The outer edge portion 22, when viewed in plan as in FIG. 3, is symmetrical about a medial axis 25 and includes a generally convex side edge portion 23 and an opposite generally concave side edge portion 24 that allows the food tray 10 to be held closely to the body of the user to catch drips and crumbs, etc. The cup-like portion 11 is positioned adjacent the midpoint of the convex side edge portion 23. One advantage of this convex-concave configuration, in comparison to that of a comparable circular tray, is that the concave side edge portion 24 reduces the maximum distance from the central axis 17 to the outermost food portions. This reduced lever arm reduces the amount of torque required by the user's hand to support the tray 10 in a horizontal plane and reduces the structural strength requirements of the tray.

The flat surface portion 13 has two ribs 15, both with the configuration of an inverted U, that extend in a radial fashion from the depending wall segment 21 of the cup-like portion 11 to the concave side edge portion 24. The ribs 15 divide the flat surface portion 13 into three separate food compartments 14 and serve to further strengthen the food tray 10. Of course, it would be readily understood by one of skill in the art that the number, placement and height of the ribs 15 and food compartments could vary from that illustrated. In a preferred embodiment, each of the ribs 15 is positioned relative to the medial axis 25 of the tray so as to define an included angle $\alpha$ of between about 10 degrees and 50 degrees, as shown in FIG. 3. This allows the user to hold the tray "squarely" against the user's body, i.e., with the medial axis 25 of the tray pointed directly at the user, when the upper portion of the thumb or lower portion of the wrist of the user is received by the underside of the ribs 15, as discussed above.

Also, as illustrated in the drawings, the ribs 15 have a height which equals the height of the upper surface of the outer edge portion 22. However, in another preferred embodiment, which is not illustrated, the height of the ribs 15, and the height of the portion of the peripheral outer edge portion 22 between the ribs 15, are substantially equal to the height of the annular wall segment 20 of the cup-like portion 11.

Figure 6:
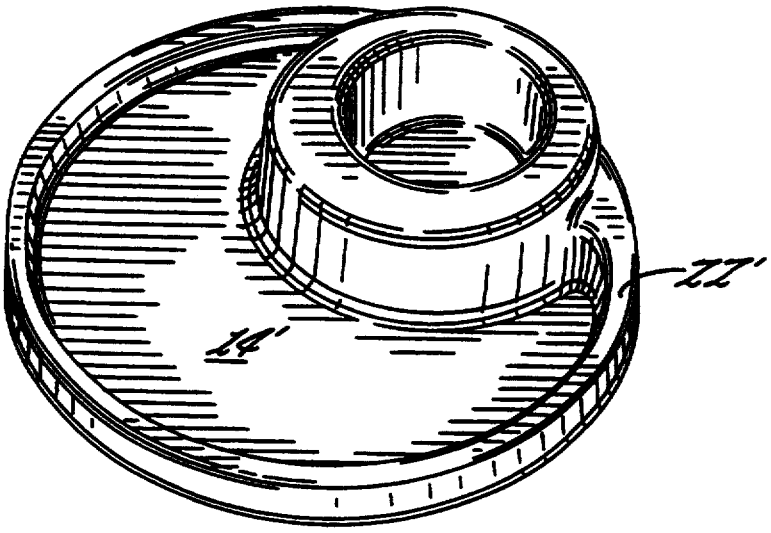
FIG. 6 is a perspective view of the top side of another embodiment of the portable food tray of the present invention.
Figure 7:
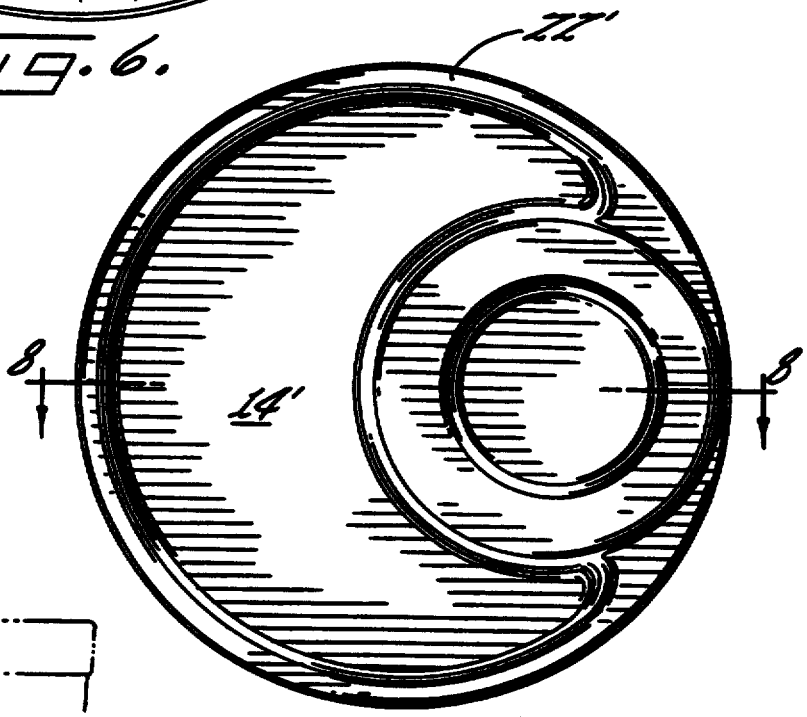
FIG. 7 is a plan view of the top side of the portable food tray of FIG. 6.
Figure 8:
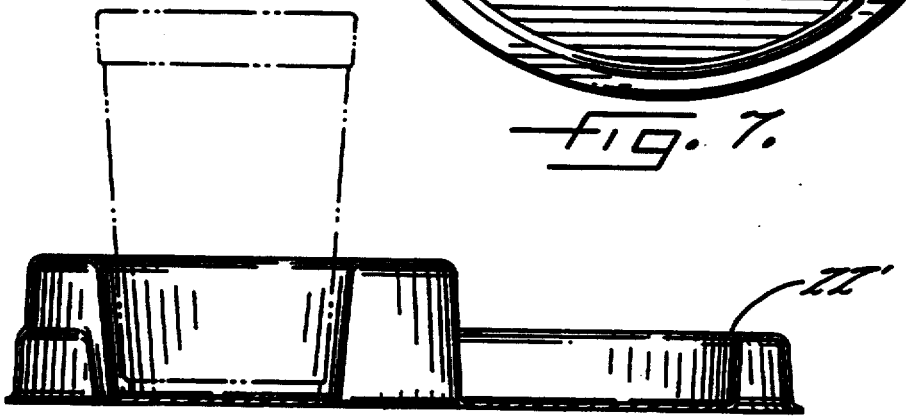
FIG. 8 is a sectional view of the portable food tray of FIG. 6 and taken along line 8—8.

Another preferred embodiment of the present invention is shown in FIGS. 6–8, with components which correspond to the embodiment of FIGS. 1–5 being indicated with the same numeral and a prime. The embodiment of FIGS. 6–8 includes a peripheral outer edge portion 22' which is circular in shape and the tray does not include any ribs. Thus, this embodiment includes only one food compartment 14'.

In the drawings and specification, preferred embodiments of the invention have been illustrated and described, and although specific terms are employed, they are used in a generic and descriptive sense and not for the purposes of limitation.

That which is claimed is:

1. A portable food tray for supporting food and a drink container and which is adapted to be securely and comfortably held by one hand of the user, and comprising a self supporting sheet material which is shaped to include a generally flat surface portion, a cup-like portion which is sized to receive a drink container and which comprises a substantially cylindrical wall, an upper open end, and a bottom end, and with said cylindrical wall defining a central axis and having an axial dimension of at least about 1½ inches, an interconnecting wall portion which interconnects said upper end of said cup-like portion to said flat surface portion so that said central axis of said cylindrical wall extends perpendicularly to said flat surface portion and said bottom end of said cup-like portion is substantially coplanar with said flat surface portion, said interconnecting wall portion including an annular wall segment joined to said upper open end of said cup-like portion and spaced above said flat surface portion, and a depending wall segment extending from said annular wall segment to said flat surface portion, and with said depending wall segment being spaced from said cylindrical wall a distance of at least about ¾ inches and configured to permit the thumb and at least the index finger of the user to surround and grip the outside of the cylindrical wall of the cup-like portion, a peripheral outer edge portion extending upwardly from the periphery of said flat surface portion to define an upper surface which is spaced above said flat surface portion, and said annular wall segment of said interconnecting wall portion being spaced above said flat surface portion a distance equal to at least about twice the spacing between said upper surface of said peripheral outer edge portion and said flat surface portion.

2. The portable food tray as defined in claim 1 further comprising at least one rib extending upwardly from said flat surface portion and which has the configuration of an inverted U in cross-section extending from said depending wall segment of said interconnecting wall portion to said peripheral outer edge portion so as to divide said flat surface portion into at least two compartments.

3. The portable food tray as defined in claim 1 wherein the distance between the depending wall segment and the cylindrical wall of the cup-like portion varies from about ¾ inches to about 1½ inches around the periphery of the cylindrical wall.

4. The portable food tray as defined in claim 1 wherein said upper surface of said peripheral outer edge portion is spaced above said flat surface portion a distance of at least about ½ inch.

5. The portable food tray as defined in claim 1 wherein said bottom end of said cup-like portion is closed with a bottom wall which is substantially coplanar with said flat surface portion.

6. The portable food tray as defined in claim 1 wherein said bottom end of said cup-like portion is closed with a bottom wall, and wherein said bottom wall is perforated so that it can be easily removed to allow the cup-like portion to more readily accommodate taller drink containers.

7. The portable food tray as defined in claim 1 wherein said peripheral outer edge portion has the configuration of an inverted U about at least the majority of its length and so as to define a depending outer wall, and wherein said depending outer wall merges into the depending wall segment at one point about the circumference of said depending wall segment.

8. The portable food tray as defined in claim 7 wherein said peripheral outer edge portion includes a generally convex side edge portion and an opposite generally concave side edge portion when viewed in plan, and wherein said cup-like portion is positioned adjacent said convex side edge portion.

9. The portable food tray as defined in claim 7 wherein said peripheral outer edge portion is generally circular when viewed in plan, and wherein said cup-like portion is positioned adjacent said peripheral outer edge portion.

* * * * *